US006247739B1

(12) United States Patent
Lyon

(10) Patent No.: US 6,247,739 B1
(45) Date of Patent: Jun. 19, 2001

(54) DEVICE FOR CARRYING CONTAINERS

(76) Inventor: Christopher Johns Lyon, P.O. Box 429, Estill, SC (US) 29918

( * ) Notice: Subject to any disclaimer, the term of this patent is extended or adjusted under 35 U.S.C. 154(b) by 0 days.

(21) Appl. No.: 09/484,909

(22) Filed: Jan. 18, 2000

Related U.S. Application Data

(63) Continuation-in-part of application No. 09/036,013, filed on Mar. 6, 1998, now abandoned.

(51) Int. Cl.[7] ..... B65D 33/06
(52) U.S. Cl. ..... 294/159; 294/26; 294/137
(58) Field of Search ..... 294/15, 26, 27.1, 294/137, 141–143, 158, 159, 167–169, 170; 220/759, 768, 770; 383/6, 13, 25; D9/434, 455

(56) References Cited

U.S. PATENT DOCUMENTS

| | | | | |
|---|---|---|---|---|
| 435,420 | * | 9/1890 | Healy | 294/26 |
| 867,886 | * | 10/1907 | Kriner | 294/26 |
| 1,137,909 | * | 5/1915 | Rusfeldt | 294/159 X |
| 1,738,844 | * | 12/1929 | Roberts | 294/26 |
| 2,506,349 | * | 5/1950 | Day | 294/26 |
| 3,761,121 | * | 9/1973 | Reid | 294/26 |
| 4,720,932 | * | 1/1988 | Bovino | 294/26 X |
| 5,171,052 | * | 12/1992 | Cunningham | 294/26 X |
| 5,398,984 | * | 3/1995 | Elder | 294/137 X |
| 5,487,581 | * | 1/1996 | Carmo et al. | 294/159 X |
| 5,599,052 | * | 2/1997 | Van Davelaar | 294/159 |
| 5,697,660 | * | 12/1997 | Smetz | 294/26 X |

FOREIGN PATENT DOCUMENTS

| | | | | |
|---|---|---|---|---|
| 186692 | * | 3/1937 | (CH) | 294/170 |

* cited by examiner

*Primary Examiner*—Johnny D. Cherry
(74) *Attorney, Agent, or Firm*—Harleston Law Firm; Kathleen M. Harleston

(57) ABSTRACT

A simple, inexpensive, portable carrying device for easing the manual carrying of containers with handles, such as full, plastic, grocery bags, is provided. The device comprises: (a) an upper grip portion comprising a grip which is adapted to be gripped in a person's hand, and a central, downwardly extending stub rod; and (b) a lower handle engagement portion comprising an upright central rod stem, and between one and ten hooks. The hooks depend from the upright central rod stem and are adapted to engage the handles of the portable containers. The upper grip portion is secured to the lower handle engagement portion by means of a joint such that the lower handle engagement portion can be rotated clockwise or counterclockwise while the upper grip portion remains stationary.

11 Claims, 9 Drawing Sheets

DEVICE FOR CARRYING CONTAINERS

CROSS REFERENCE TO RELATED APPLICATION

This is a continuation-in-part of application Ser. No. 09/036,013, filed on Mar. 6, 1998, now abandoned.

BACKGROUND OF THE INVENTION

1. Technical Field

The present invention relates to a device for carrying portable containers with handles generally, and is more particularly directed to a portable carrying device for easing the manual transport of containers that have handles and can be carried by a person.

2. Background Information

Conventional carrying handles, such as those which are provided, for example, on some kinds of carrier bags made of plastic material for supermarket shopping, are frequently uncomfortable to hold. Full supermarket bags tend to press unpleasantly into the hand if the contents of the bag are at all heavy, particularly when the bags must be borne some distance to a car or home. This also applies to handles made of small diameter rod, such as the narrow handles on paint tins. These are but two specific examples. The problem is, though, associated with any type of container or holder of goods with uncomfortable handles. The present device reduces or eliminates such problems.

The present invention provides a simple, inexpensive carrying device for easing the manual carrying of containers which have handles. The device can be used to help transport, for example, paper grocery bags with plastic or paper handles, plastic grocery or department store bags, and canvas carrying bags with handles. The present device has a grip portion and a handle engagement portion. The handle engagement portion has a hook or hooks which in use extend in a generally upright configuration below the grip portion. The handle or handles of the goods to be carried are then simply engaged with (hung on, for example) the hook or hooks for manual transport.

BRIEF SUMMARY OF THE INVENTION

The present portable device is for carrying one or more portable containers with handles. The device comprises: (a) an upper grip portion comprising a grip which is adapted to be gripped in a person's hand, and a central, downwardly extending stub rod; and (b) a lower handle engagement portion comprising an upright central rod stem, and between one and ten hooks. The hooks depend from the upright central rod stem and are adapted to engage the handles of the portable containers. The upper grip portion is secured to the lower handle engagement portion by means of a joint such that the lower handle engagement portion can be rotated clockwise or counterclockwise while the upper grip portion remains stationary.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
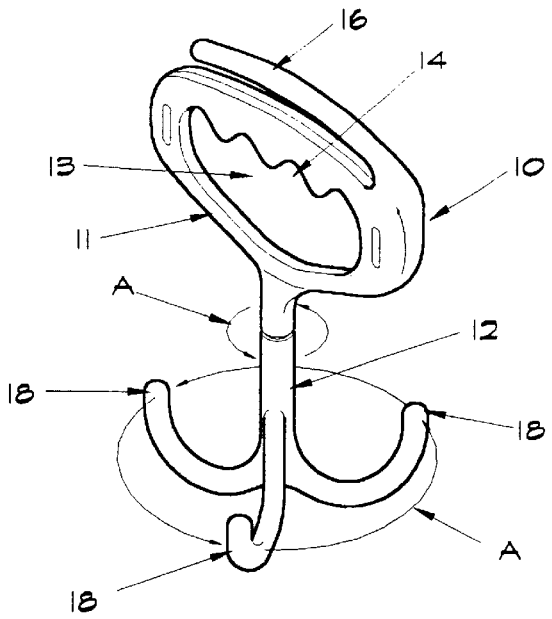
FIG. 1 is a perspective view of a carrying device according to the present invention.

In the following description, like reference characters designate like or corresponding parts throughout the several views. Also, in the following description, it is to be understood that such terms as "front," "top," "bottom," "within," and the like are words of convenience and are not to be construed as limiting terms. Referring in more detail to the drawings, the invention will now be described.

Figure 2:
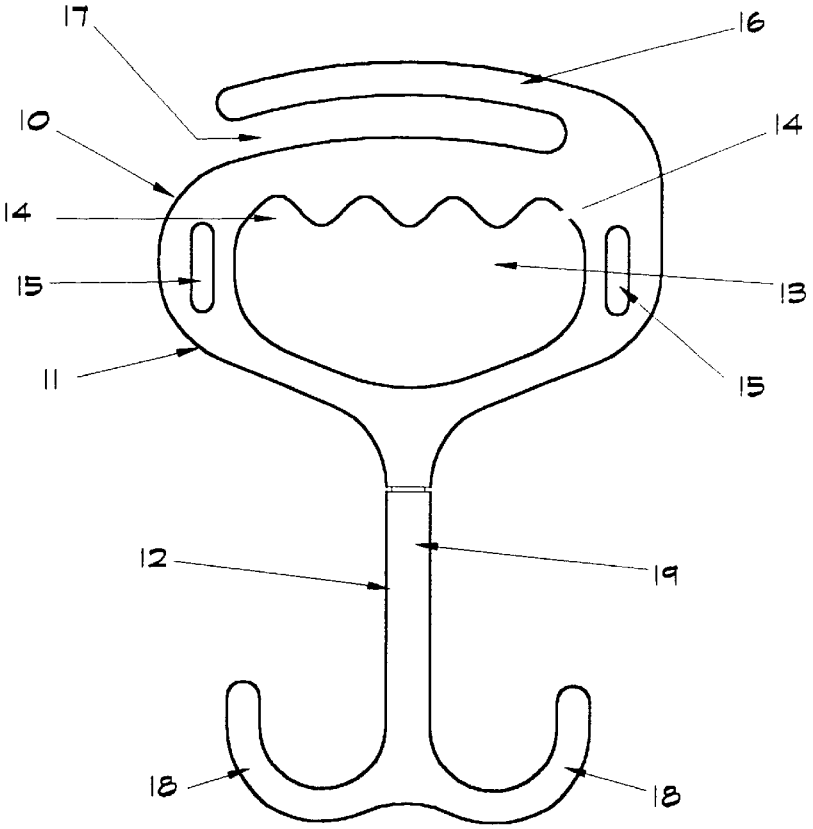
FIG. 2 is an elevational front view of the device as shown in FIG. 1.
Figure 3:
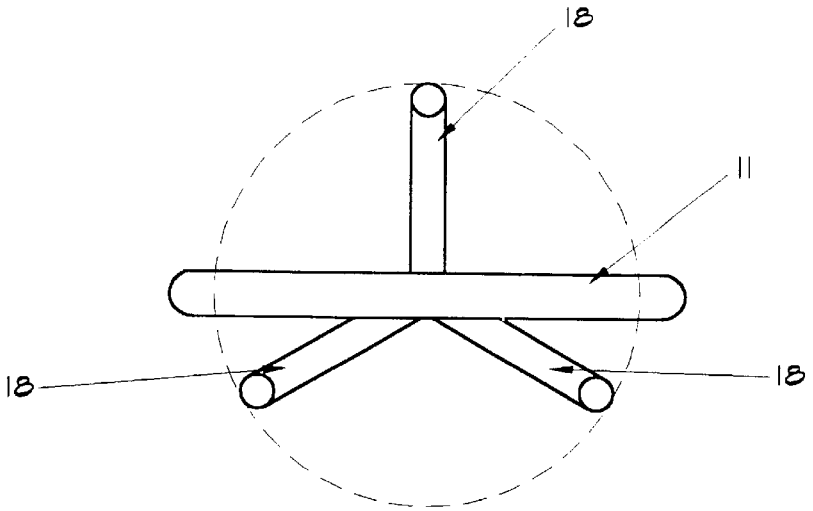
FIG. 3 is a plan view of the device as shown in FIG. 1.

Referring to FIG. 1, the present device is adapted to manually transport supermarket bags or other portable containers with handles. The carrying device of the present invention is preferably injection molded out of plastics material, which allows large scale manufacture at a reasonably low cost. In the drawings, the carrying device 10, which is made of ABS plastics material, has an upper grip portion 11 and a lower handle engagement portion 12. FIGS. 1 and 2 are different views of the same device.

In FIGS. 1 and 2, the upper grip portion 11 of the device 10 comprises a generally elliptical grip 14 with contours. The grip comprises a central aperture 13 that is adapted to receive the hand of the user. The upper part of the ellipse form has contours at the central aperture 13 to receive the fingers of the hand when the user grips the device in order to carry it.

At opposite sides of the ellipse, two upright slots 15 in the grip 14 are provided. These upright slots 15 are adapted to receive a belt worn by the user or a purse strap so that the device can be stored when it is not in use. To carry the device, the belt or purse strap can be unbuckled, inserted through the two upright slots 15, and then buckled again.

An optional prong 16 that is very slightly arcuate extends generally horizontally and parallel to the contoured, widest part of the ellipse, giving rise to a substantially horizontal upper slot 17 that is blind at the right hand end as seen in the front view of FIG. 2. The horizontal slot 17 is capable of receiving a strap, such as the strap of a shoulder bag or a belt of the user, through the open left hand end of the device. The belt or pocketbook strap need not be unbuckled to insert it into the horizontal slot 17 in this fashion. This position could be employed during use of the device as a carrier, or for storage when the device is not in use. The device can thus be attached to a purse or belt and is readily detachable.

Figure 4:
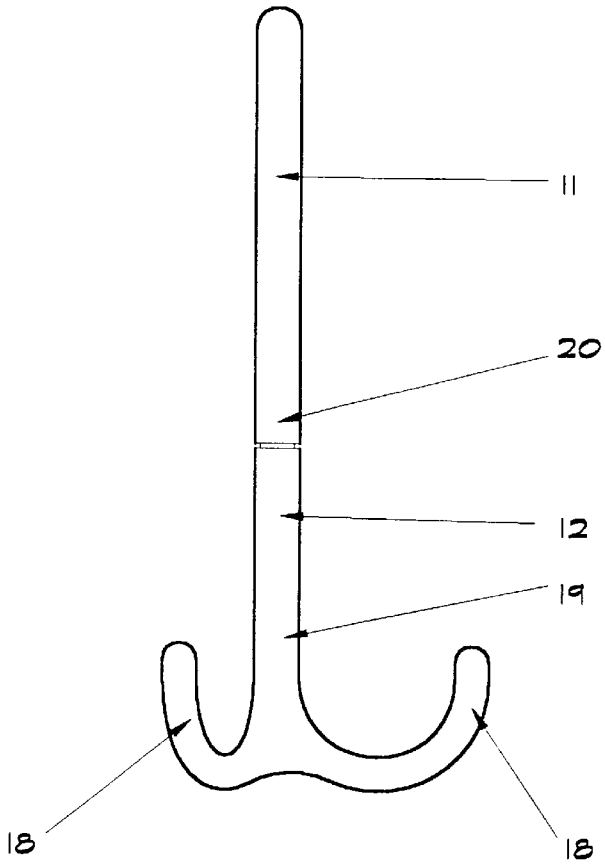
FIG. 4 is a side view of the handle engagement portion of the device as shown in FIG. 1.

In the embodiment of FIGS. 1 through 5, the lower part of the lower handle engagement portion comprises three hooks 18 sharing a common upright rod stem 19. In the plan view of FIG. 3, the hooks subtend an angle of 120 degrees, one with another. The hooks 18 are adapted to engage the handles of supermarket carrier bags or other containers, which can easily be slipped over the hooks 18. The side view of the handle engagement portion 12 in FIG. 4 shows two of the hooks 18 and the common upright rod stem 19.

Figure 5:
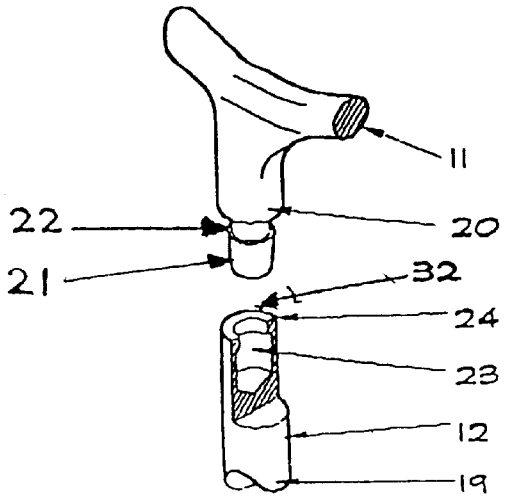
FIG. 5 is a cut-away, perspective view of a lower part of the grip portion and an upper part of the handle engagement portion of the device shown in FIG. 1.

FIG. 5 is a cut-away view of a lower part of the grip portion 11 and an upper part of the handle engagement portion 12 showing how they are connected to each other. The grip portion 11 is formed with a central, downwardly extending stub rod 20. In a preferred embodiment, the upper grip portion 11 consists essentially of the generally elliptical grip 14 and the central, downwardly extending stub rod 20. In this preferred embodiment, the central, downwardly extending stub rod 20 has a male connecting part 21 at its lower end with a groove ring recess 22. In turn, the upright rod stem 19 has a female connecting part 23 at its upper end with a ring 24. The male connecting part 21 is adapted to snap into the female connecting part 23, and the grip portion 11 is thus rotatably secured to the lower handle engagement portion 12 in a manner indicated by rotation arrows A.

Thus in use a person can place his or her fingers through the central aperture 13 and grip the upper grip portion 11 of the present device 10, with the base of the fingers fitting into the four contours of the grip 14. The user can use his or her free hand to place the handles of the parcels/containers over one or more of the hooks 18. The lower handle engagement portion 12 of the device can be rotated 360 degrees at the point of connection between the upper female connecting part 23 of the grip portion and the lower male connecting part 21 of the handle engagement portion. This ability to rotate the top or bottom half of the present device facilitates placement of the bags on the hooks 18, or of the device 10 on the purse or belt strap.

For compact storage in a pocket or handbag, the snap fit arrangement between the male and female connecting parts 21 and 23 can be replaced or supplemented by a joint, such as a knuckle joint (not shown), which enables the user to fold the device in half so that the grip portion 11 and the engagement portion 12 face each other. This would facilitate storing or carrying the device in the pocket or pocketbook.

Figure 6:
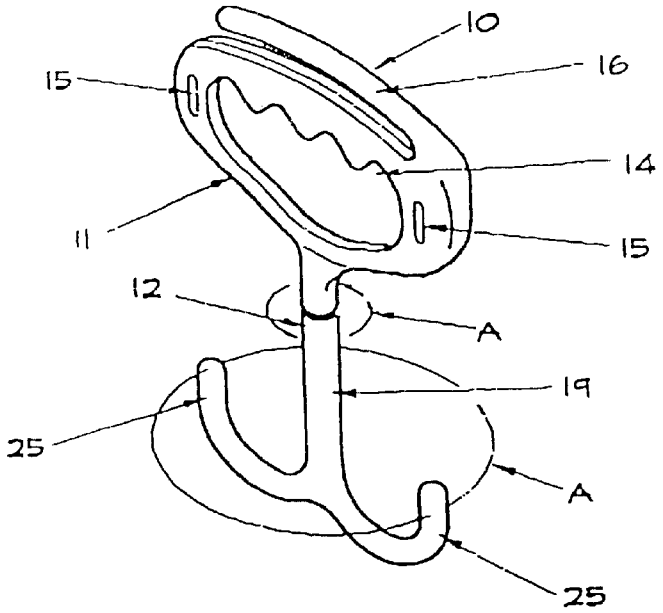
FIG. 6 is a perspective view of an alternate embodiment according to the present invention.
Figure 7:
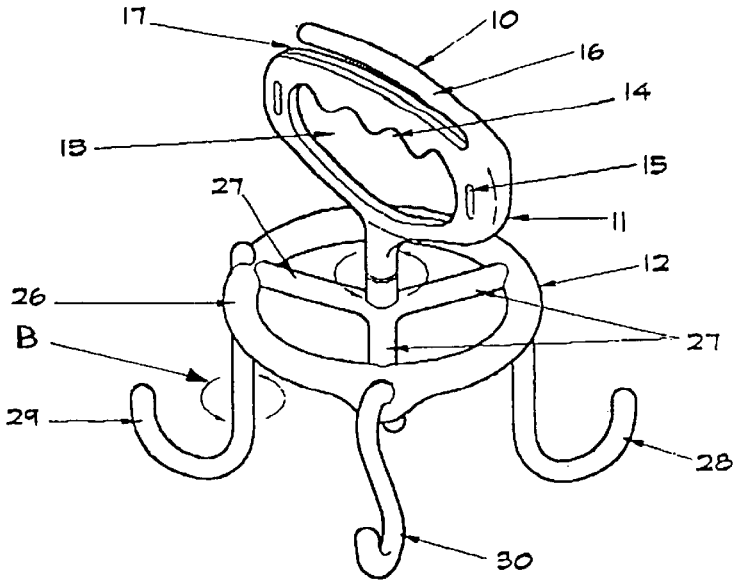
FIG. 7 is a perspective view of another alternate embodiment according to the present invention.

FIGS. 1 through 5 show the preferred embodiment of the present device. FIGS. 6 and 7–10 show alternate embodiments of the present invention. The embodiment of FIG. 6 differs from the embodiment of FIG. 1 in that the FIG. 6 device has two hooks 25 in place of the three hooks 18 shown in FIG. 1. The hooks 25 of FIG. 6 are disposed in line.

The device of FIGS. 7 through 10 has a three-hook arrangement that differs from the three hooks of the device of FIGS. 1 through 5. Referring to the isometric view of FIG. 7 and the front view of FIG. 8, a horizontal ring 26 is attached by three equally spaced radial arms 27 extending from the upright rod stem 19 at the approximate geometric center of the horizontal ring 26. The three hooks of the device 10 are a fixed hook 28, a swivel hook 29, and an "S"-shaped hook 30. They depend from the horizontal ring 26. The upper end of the "S"-shaped hook 30 is received in an eye 31 of the horizontal ring 26. A parcel with its handles hooked on the "S"-shaped hook 30 can swing more easily from side to side. The swivel hook 29 can swivel or turn in a manner indicated by rotation arrows B. Several combinations of these types of hooks are possible in other embodiments. For example, a device according to the present invention could have one fixed hook and one swivel hook.

Figure 8:
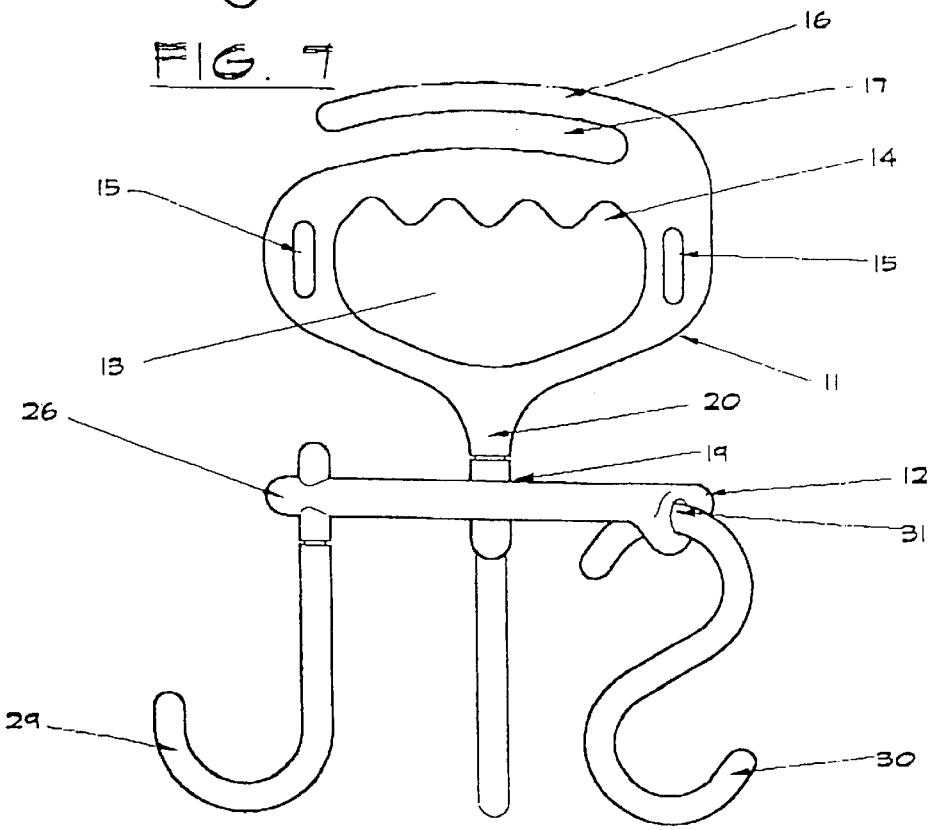
FIG. 8 is a front view of the device as shown in FIG. 7.
Figure 9:
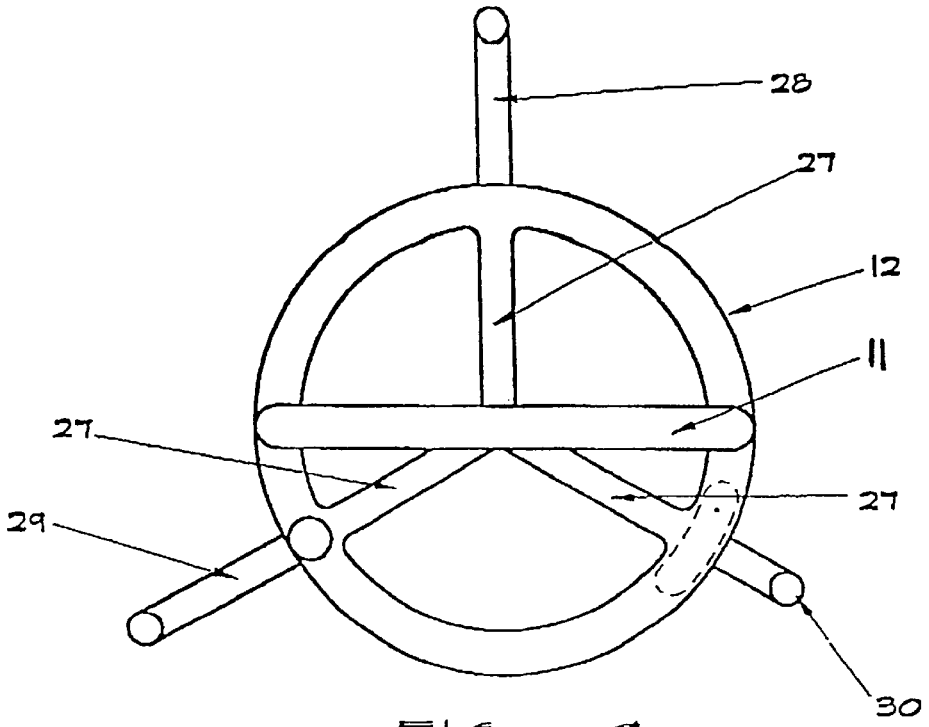
FIG. 9 is an elevational, plan view of the device shown in FIG. 7.
Figure 10:
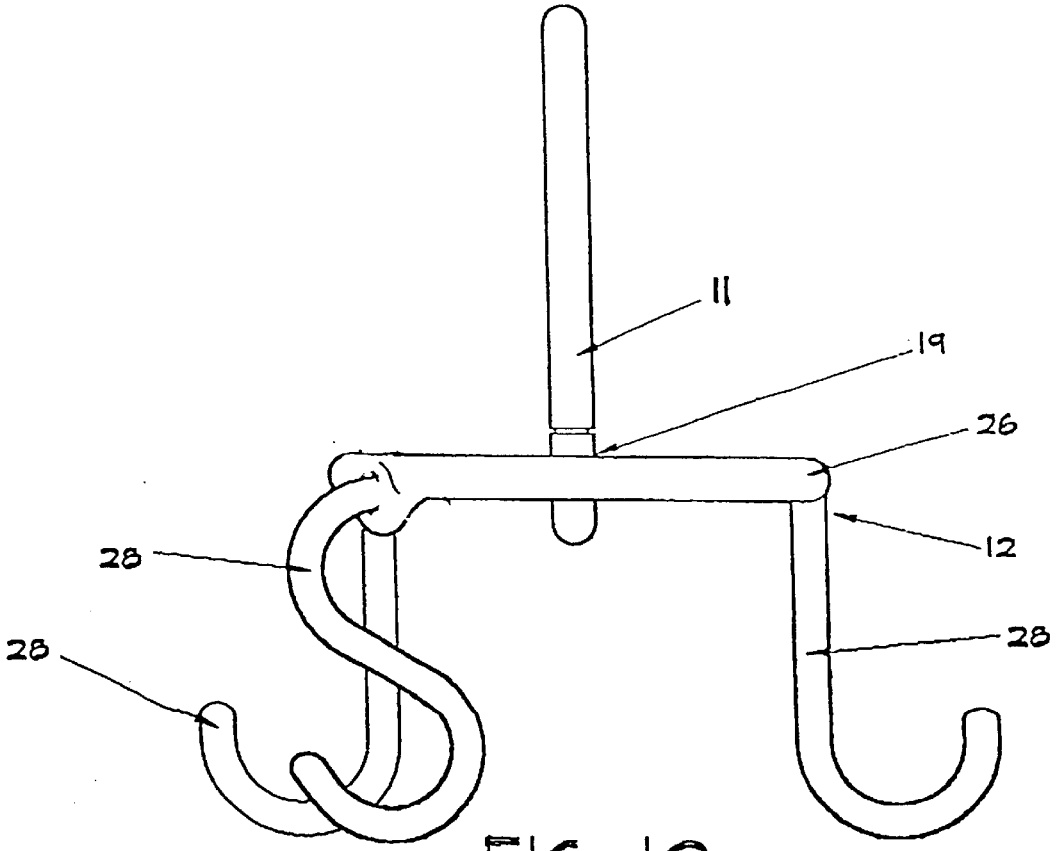
FIG. 10 is a side view of a carrying device according to the present invention.

As can be seen in the plan view of FIG. 9, the three hooks are located at the junctures of the radial arms 27 and the horizontal ring 26. The side view of FIG. 10 shows in particular the lower engagement portion of an alternate embodiment of the carrying device 10. The upper handle portion 11 is as shown in FIG. 8. In FIG. 10, three stationary hooks 28 depend from a horizontal ring 26.

In use, the handles of one or more loaded supermarket carrier bags are simply slipped over the hooks of the above-described carrying devices and the grip portion is held in the hand as already indicated. The grip is more comfortable than holding the generally flimsy strands of plastics material that usually serve as handles on supermarket carrier bags. Also, it is easier to drop a bag or goods from a bag when one is juggling several full grocery bags at once. When the person has to carry several bags of groceries from the store, it is often necessary to hold a full bag between the forearm and the chest. The collapsible nature of the plastic grocery bag makes it difficult to do that without spilling items from the bag onto the ground. The present device, though, avoids that problem by making it easier for a person to carry several full bags at once. Also, the symmetry of the present device enables better balance to be obtained between a number of bags.

Preferably, the present device is between about 3 and 12 inches, or 7.62 and 30.48 centimeters, more preferably between about 6 and 10 inches, or 15.24 and 25.4 centimeters, in length. The device is preferably between about 2 and 8 inches, or 5.08 and 20.32 centimeters, more preferably between about 4 and 6 inches, or 10.16 and 15.24 centimeters, at its widest point, which is across the grip portion. Preferably, the upper grip portion makes up approximately half of the length of the present device, and the other half is the handle engagement portion.

In summary, this is a portable device for carrying one or more portable containers with handles, preferably one or two bags with handles made of plastics material. The bags preferably contain goods for transport and are most preferably collapsible plastic grocery or department store bags. Clearly, such devices can be used for carrying many other types of containers. For example, paint cans often have small cross section rod handles which are awkward to carry and also tend to press uncomfortably into the flesh of the hand.

In the present invention, the lower handle engagement portion of the present device comprises an upright central rod stem and between one and ten hooks, preferably two or three hooks, and most preferably three hooks, which are equi-spaced and which subtend an angle of approximately 120 degrees from each other. The hooks depend from the upright central rod stem and are adapted to engage the handles of the portable containers. The hooks are more preferably fitted to hold the handles of one or two full (not empty) plastic grocery bags. Preferably, the hooks depend from a horizontal ring which depends from equi-spaced radial arms which depend from the upright central rod stem. More preferably, three hooks depend from the horizontal ring at the points where three equally spaced radial arms join the horizontal ring.

The device comprises an upper grip portion 11, which comprises a grip 14 comprising a central aperture 13 and a central, downwardly extending stub rod 20. The grip 14 is generally elliptical or triangular in shape and is between about two inches, or 10.16 centimeters, and about six inches, or 30.48 centimeters, at its widest point. The grip 14 is preferably made to fit the hand comfortably by appropriate contouring so that the grip portion lies snugly in the hand.

Preferably, then, the upper grip portion comprises contours at the upper part of the central aperture, the contours being of sufficient number and size to accommodate a hand of the user. Referring to FIG. 5, the upper grip portion also preferably further comprises two, equal, parallel, upright slots; each slot being between about ½and two inches, or 1.27 and 5.08 centimeters, long, and between about 1/32and ½inch, or 0.79 and 12.7 millimeters, wide. Most preferably, the upper grip portion also further comprises an upper horizontal prong of sufficient size to accommodate a belt or strap; the belt or strap being between about ½and two inches, or 1.27 and 5.08 centimeters, wide, and between about 1/32and ¼inch, or 0.79 and 6.35 millimeters, thick.

The upper grip portion 11 is secured to the lower handle engagement portion 12 by means of at least one joint such that the upright central rod stem 19 of the lower handle engagement portion 12 can be pivoted around in a circular motion of up to 360 degrees while the upper grip portion remains stationary (or vice versa). Optionally, one joint is foldable 32 and the present carrying device has a first, locked, open position for carrying the containers and a second, folded, closed position for storage of the device. Preferably, the downwardly extending stub rod 20 has a male connecting part 21 at its lower end, the upright central rod stem 19 has a female connecting part 23 at its upper end, and the male connecting part 21 fits into the female connecting part 23 such that the upper grip portion 11 is secured to the lower handle engagement portion 12. Most preferably, the male connecting part 21 comprises a groove ring recess 22, the female connecting part 23 comprises a ring 24, and the male connecting part 21 snaps into the female connecting part 23.

Figure 11:
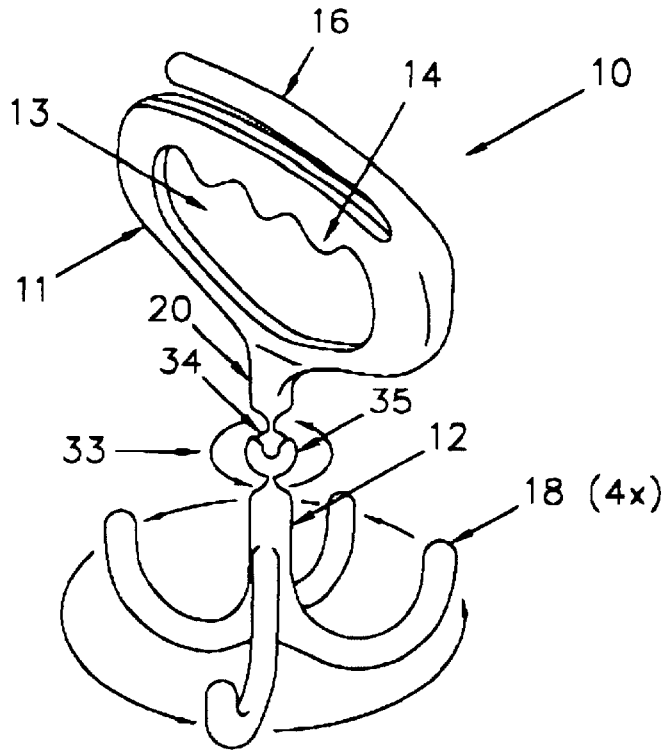
FIG. 11 is a perspective view of a carrying device according to the present invention.
Figure 12:
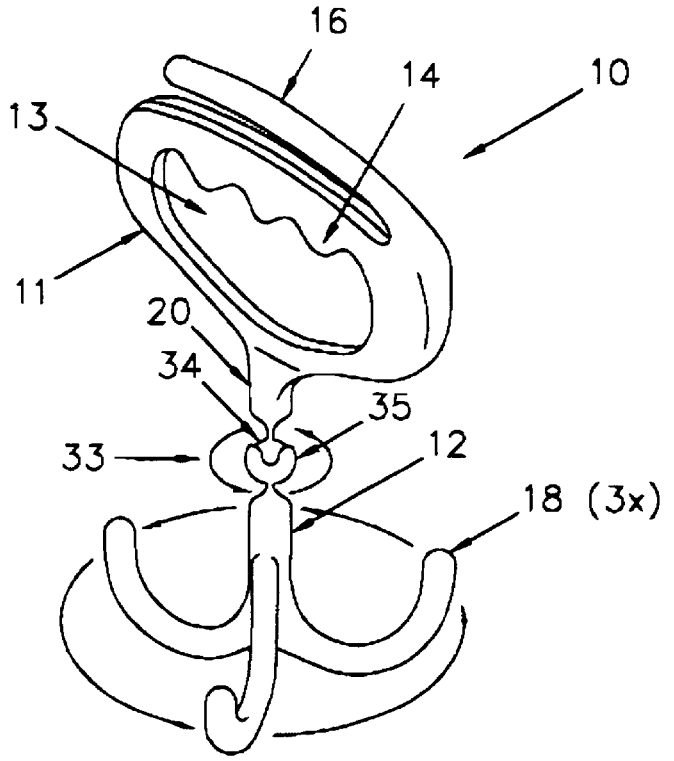
FIG. 12 is a perspective view of a carrying device according to the present invention.

Referring to FIGS. 11 and 12, four hook and three hook 18 embodiments of the carrying device 10 are shown. Both include a foldable, rotatable joint 33 between the upper grip portion 11 and the lower handle engagement portion 12. The user can rotate the upper grip portion completely around, if desired. Thus, the user can place a grocery bag on a hook on the lower handle engagement portion 12, then turn the device clockwise or counterclockwise so that a free hook (i.e., hook with nothing on it yet) is facing front, and then load the next grocery bag on the free hook.

Figure 13:
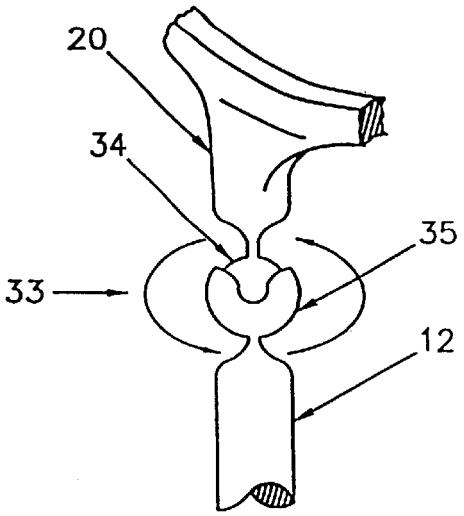
FIG. 13 is a cut-away, perspective view of a lower part of the grip portion and an upper part of the handle engagement portion of the device shown in FIG. 12.
Figure 14:
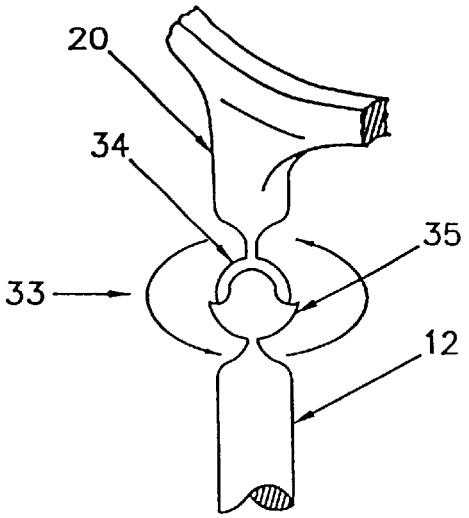
FIG. 14 is a cut-away, perspective view of a lower part of the grip portion and an upper part of the handle engagement portion of the device shown in FIG. 12.

As is shown in FIGS. 11–13, the joint 33 comprises a ball pivot connection 34 and a cup pivot connection 35. A ball portion of the ball pivot connection 34 fits into the cup portion of the cup pivot connection. FIG. 13 shows the joint 33 from one side, and FIG. 14 shows the joint from a different aspect. The joint is preferably made of a hard, durable plastic.

Figure 15:
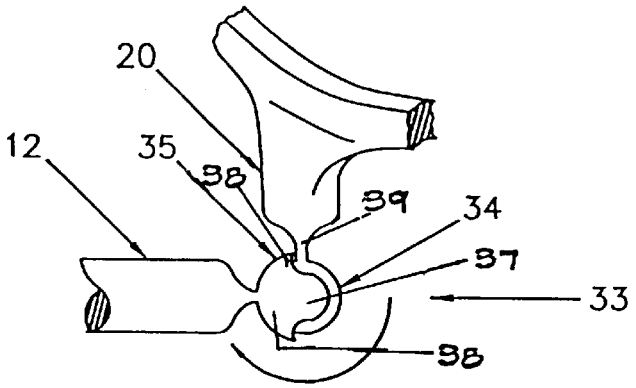
FIG. 15 is a cut-away, perspective view of a lower part of the grip portion and an upper part of the handle engagement portion of the device shown in FIG. 12.

As shown in FIGS. 14–15, rather than being hemispherical in shape, the edges of the cup pivot connection curve down on opposite sides. Thus, it has two opposite quadrants that are higher 37 and cup around the ball pivot connection, and two low quadrants 38 on opposite sides of the cup pivot connection. When the user rotates the upper grip portion, holding the lower handle portion stationary, the ball portion is being moved clockwise or counterclockwise in the cup portion. The ball portion can also be rotated up and down somewhat at the same time.

Referring to FIG. 15, the ball pivot connection includes a thin bridge portion 39. When the user folds the upper grip portion down for storage of the device as is shown in FIG. 15, the thin bridge portion is moved down into one of the two lower quadrants 38.

Figure 16:
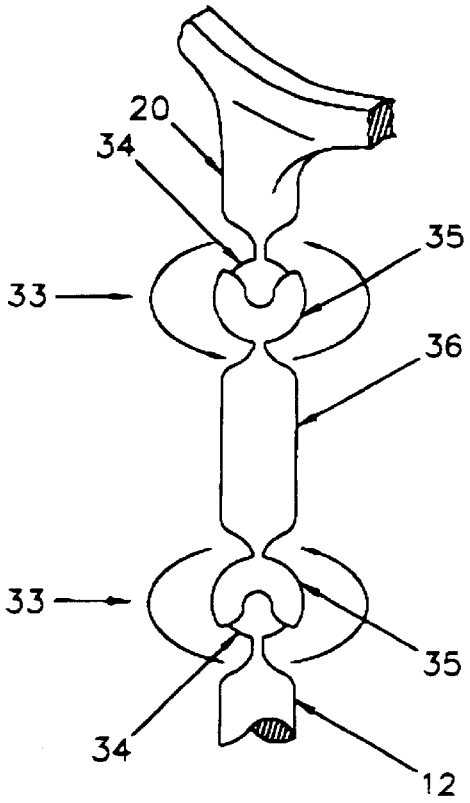
FIGS. 16–18 are a cut-away, perspective views of a lower part of the grip portion and an upper part of the handle engagement portion of a device according to the present invention.
Figure 17:
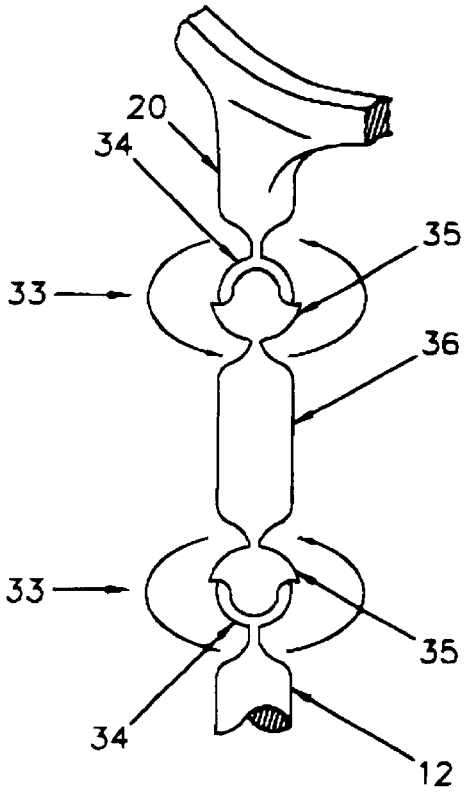
Figure 18:
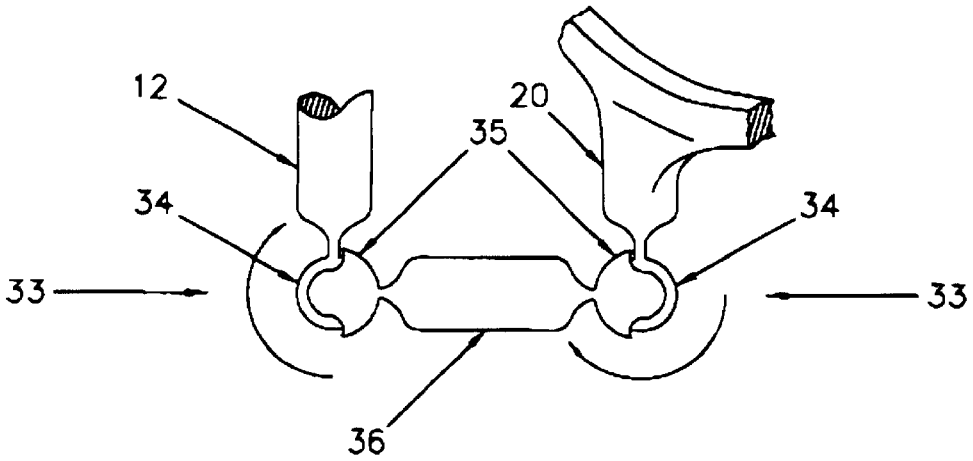
Figure 19:
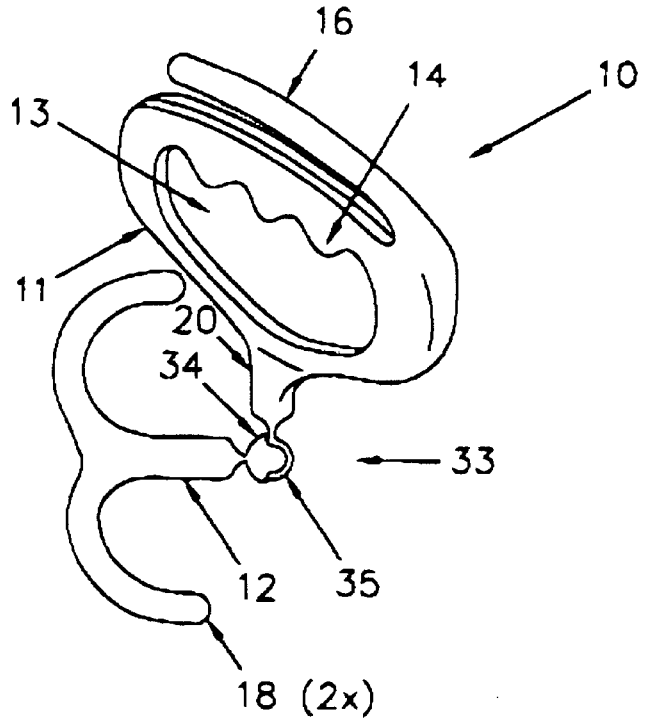
FIGS. 19 & 20 are perspective views of carrying devices according to the present invention.
Figure 20:
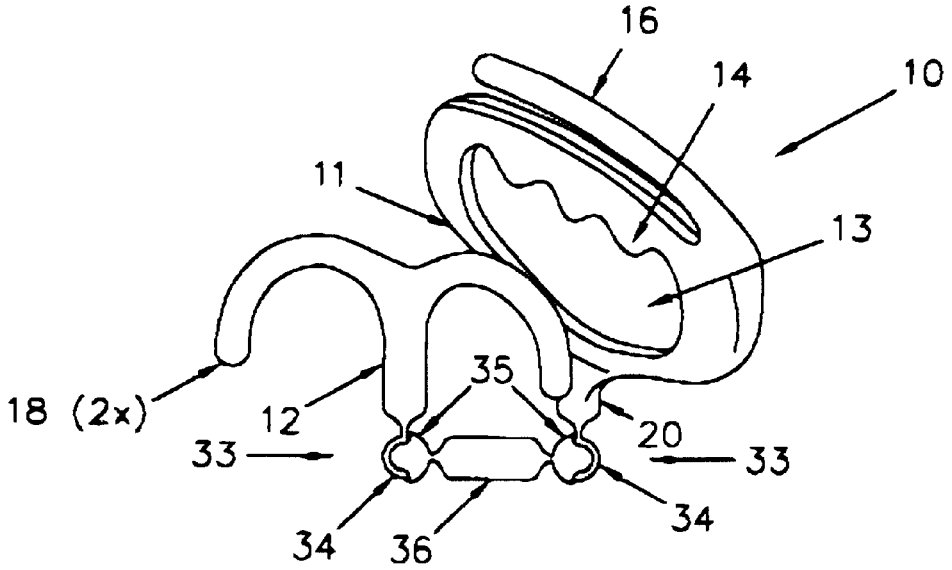

FIGS. 16–18 show another embodiment of the carrying device with two rotatable, foldable joints 33. Here, the cup pivot connections 35 face opposite ways. This embodiment permits the carrying device 10 to be folded into an even more compact form, as shown in FIG. 20. The device can be twisted and folded into more portions with two joints. FIG. 19 shows a folded device having one rotatable, foldable joint.

Many forms of the carrying device of the invention are possible. In one simplified form (not shown), the grip is generally triangular in front view. The upper grip portion can be made of a filled, plastic tube of the approximate diameter of the hooks in the lower handle engagement portion. To carry the device, the hand is placed in the triangular aperture in the center of the upper grip portion and the uppermost edge of the triangle is gripped. The uppermost edge of the grip portion is preferably contoured to fit the fingers of the user's hand.

In another simplified form (not shown), the device is a single shaped bar which is used in horizontal disposition. The bar is threaded through the handle which hangs from the upper face of the bar, and the bar is gripped by its underside. The underside of the bar is therefore the grip portion and the upper face of the bar is the handle engagement portion.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A portable device for carrying one or more portable containers with handles, the device comprising:

(a) an upper grip portion comprising a grip and a central aperture for receiving a person's hand, and a central, downwardly extending stub rod; and (b) a lower handle engagement portion comprising an upright central rod stem, and between one and five hooks; the hooks depending from the upright central rod stem for engaging the handles of the portable containers; and wherein the central, downwardly extending stub rod is secured to the upright central rod stem by means of a joint such that the lower handle engagement portion can be rotated clockwise or counterclockwise while the upper grip portion remains stationary; and wherein the joint is foldable and the device has a first, open position for carrying the bags and a second, folded, closed position for storage of the device.

2. A device according to claim 1, wherein the central aperture is between about two inches, or 10.16 centimeters, and about six inches, or 30.48 centimeters, at its widest point, and the handle engagement portion comprises two hooks.

3. A device according to claim 2, wherein the upper grip portion further comprises an upper horizontal prong for a belt or strap, and two upright slots for receiving a belt worn by the user or a purse strap.

4. A device according to claim 2, wherein the hooks depend from a horizontal ring which depends from equally spaced radial arms which depend from the upright central rod stem.

5. A device according to claim 4, wherein the device comprises three stationary hooks which depend from the horizontal ring at the points where three equi-spaced radial arms join the horizontal ring.

6. A device according to claim 1, wherein the handle engagement portion comprises three hooks which are equi-spaced and which subtend an angle of approximately 120 degrees from each other.

7. A device according to claim 6, wherein the downwardly extending stub rod has a male connecting part, the upright central rod stem has a female connecting part, and the male connecting part fits into the female connecting part such that the upper grip portion is moveably secured to the lower handle engagement portion.

8. A device according to claim 7, wherein the male connecting part comprises a groove ring recess, the female connecting part comprises a ring, and the male connecting part snaps into the female connecting part.

9. A device according to claim 8, wherein the grip is generally elliptical in shape and further comprises contours at an upper part of the central aperture; the contours being of sufficient number and size to accommodate a hand of the user.

10. A device according to claim 9, wherein the grip further comprises two, equal, parallel, upright slots; each slot being between about ½ and two inches, or 1.27 and 5.08 centimeters, long, and between about 1/32 and ½ inch, or 0.79 and 12.7 millimeters, wide.

11. A device according to claim 10, wherein the upper grip portion further comprises an upper horizontal prong of sufficient size to accommodate a belt or strap; the belt or strap being between about ½and two inches, or 1.27 and 5.08 centimeters, wide, and between about 1/32and ¼inch, or 0.79 and 6.35 millimeters, thick.

* * * * *